US005351858A

United States Patent [19]

Bar-Yona et al.

[11] Patent Number: 5,351,858

[45] Date of Patent: Oct. 4, 1994

[54] TABLET DISPENSER

[75] Inventors: Itzhak Bar-Yona, Neve Monoson; Mordechai Teicher, Kfar Saba, both of Israel

[73] Assignee: Log-Plastic Products, Kibbutz Ashdod Yaacov Ichud, Israel

[21] Appl. No.: 980,073

[22] Filed: Nov. 23, 1992

[51] Int. Cl.[5] ..... B65G 59/00

[52] U.S. Cl. ..... 221/266; 221/155

[58] Field of Search ..... 221/266, 301, 298, 202, 221/203, 205, 155

[56] References Cited

U.S. PATENT DOCUMENTS

| | | | |
|---|---|---|---|
| 2,282,036 | 5/1942 | Cobbs et al. | 221/266 |
| 3,161,321 | 12/1964 | Mellion et al. | 221/266 |
| 3,414,162 | 12/1968 | Leonforte | 221/266 |
| 3,896,967 | 7/1975 | Doolittle | 221/266 |

FOREIGN PATENT DOCUMENTS

| | | | |
|---|---|---|---|
| 1092770 | 11/1954 | France | 221/266 |
| 484992 | 9/1953 | Italy | 221/266 |
| 8295 | of 1915 | United Kingdom | 221/266 |

*Primary Examiner*—Robert P. Olszewski
*Assistant Examiner*—Kenneth Noland
*Attorney, Agent, or Firm*—Benjamin J. Barish

[57] ABSTRACT

A tablet dispenser includes a housing of rectangular configuration about the size of a credit card and formed with a compartment for holding a plurality of tablets, e.g., artificial sweetener tablets. The compartment is of a thickness only slightly greater than the thickness of the tablets to be dispensed such as to accommodate a single layer of tablets within the compartment. The housing is formed with an opening at one of the corners of the rectangle for dispensing tablets from the compartment, and a pivotal dispensing member is provided to dispense a single tablet from the compartment through the opening.

12 Claims, 2 Drawing Sheets

TABLET DISPENSER

FIELD AND BACKGROUND OF THE INVENTION

The present invention relates to a tablet dispenser. The invention is particularly useful for dispensing artificial sweetener tablets, and is therefore described below with respect to this application, but it will be appreciated that the invention could advantageously be used for dispensing other types of tablets, such as pharmaceutical tablets.

Many different constructions of tablet dispensers are known for holding a plurality of tablets and for dispensing them individually as and when required. The present invention provides a new tablet dispenser of very simple structure which can be produced in volume at low cost and which can be conveniently carried by the user.

BRIEF SUMMARY OF THE INVENTION

According to the present invention, there is provided a tablet dispenser comprising a housing formed with a compartment for receiving a plurality of tablets to be dispensed, and with a dispensing opening for dispensing tablets from the compartment. The housing includes a top wall, a bottom wall, first and second opposed side walls, and first and second opposed narrow end walls, the dispensing opening being formed in the first end wall adjacent the bottom wall. The compartment is of a length and width to receive a plurality of tablets, but of a thickness, defined by the first and second narrow end walls, only slightly greater than the thickness of one of the tablets such that the tablets received therein form a single layer. A dispensing member is mounted between the side walls adjacent the dispensing opening in the first end wall and is manually movable either to a closed position closing the dispensing opening, or to an open position to dispense a tablet from the compartment through the dispensing opening. The dispensing member is pivotally mounted at a pivot point intermediate a first end thereof facing the top wall and a second end thereof facing the bottom wall. The second end of the dispensing member is formed on an inner surface thereof with a recess for receiving a single tablet. The arrangement is such that manually pressing the first end of the dispensing member inwardly towards the second end wall, while the dispensing member is in its closed position, pivots the second end of the dispensing member outwardly from the first end wall to the open position to dispense the single tablet received in the recess in the second end through the dispensing opening.

According to additional features in the described preferred embodiment, the dispenser further includes a spring normally urging the dispensing member to its closed position but permitting the dispensing member to be manually moved to its open position to dispense a tablet from the compartment through the dispensing opening.

According to still further features in the described preferred embodiment, the housing is of the general shape and dimensions of a credit card, with the dispensing opening and dispensing member being located at a corner of the housing.

As will be more apparent from the description below, a tablet dispenser constructed in accordance with the foregoing features may be produced in volume and at low cost, which makes such dispensers particularly useful for dispensing artificial sweetener tablets. Moreover, such a construction enables the dispenser to be conveniently carried in the purse or wallet of the user.

According to a still further feature in the described preferred embodiment, the housing is transparent at the location of the dispensing opening, to permit viewing the dispensing of single tablets therefrom. This feature is particularly advantageous when dispensing artificial sweetener tablets. Thus, when using a conventional dispenser for this purpose, the usher generally dispenses the tablets first to the user's palm and then drops the tablet into the liquid to be sweetened, to make sure that only a single table is added at a time. However, when the user can clearly see that a single table is being dispensed, the user would be more inclined to dispensing the tablets directly into the liquid to be sweetened, thereby making the dispensing of the tablets not only faster and more convenient, but also more hygienic since the tablet would not contact the user's hands.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
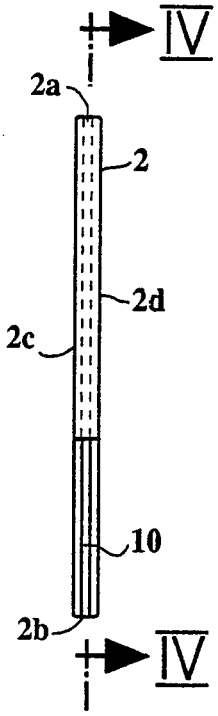
FIG. 1 is an end elevational view illustrating one form of tablet dispenser constructed in accordance with the present invention.

The tablet dispenser illustrated in FIGS. 1–5 of the drawings is designed particularly for dispensing artificial sweetener tablets into coffee, tea, or other liquid. The dispenser is constructed to be of the general size and shape of a standard credit card, thereby enabling the dispenser to be conveniently carried by the user.

More particularly, the illustrated dispenser includes a housing, generally designated 2, formed with a compartment 4 for receiving a plurality of tablets 6 to be dispensed. Housing 2 is of polygonal shape, preferably of the rectangular shape and general dimensions of a standard credit card. One corner of the housing 2 is cut-away to define a dispensing opening 8. This opening is occupied by a dispensing member 10 pivotally mounted to the housing by a pin 12. Housing 2 includes a top wall **2*a*, a bottom wall 2*b*, first and second side walls 2*c*, 2*d*, and first and second narrow end walls 2*e*, 2*f*. The dispensing opening is formed in end wall 2*e* adjacent to the bottom wall 2*b*. The pivotal mounting (pin 12) of the dispensing member 10 is at an intermediate point such as to define a first end 10*a* of the dispensing member on one side of pivot point 12** facing the top wall 2*a*, and a second end 10*b* of the dispensing member on the opposite side of the pivot point and facing the bottom wall 2*b*.

A standard credit card is of 85 mm in length and 55 mm in width. Preferably, the illustrated housing 2 has a length of 75–100 mm and a width of 45–65 mm. The housing thickness should be sufficient such that its compartment 4 is only slightly larger than one of the tablets 6 so as to accommodate only a single layer of the tablets. Depending on the thickness of these tablets, housing 2 would generally be between 3–10 mm in thickness.

Figure 2:
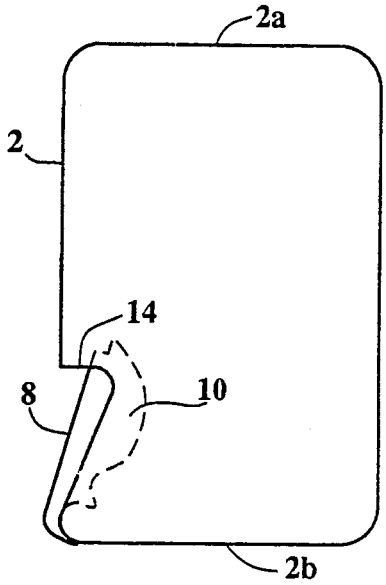
FIGS. 2 and 3 are side elevational views of the dispenser illustrated in FIG. 1 when the dispensing member is in its open position and closed position, respectively.
Figure 3:
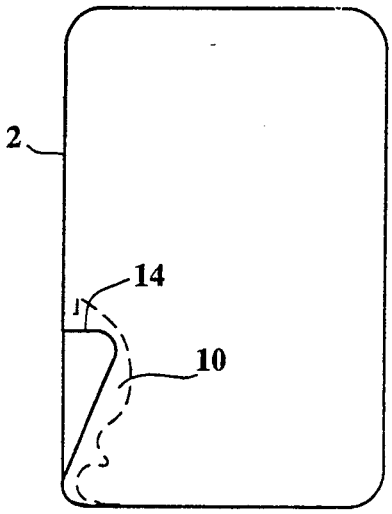
Figure 4:
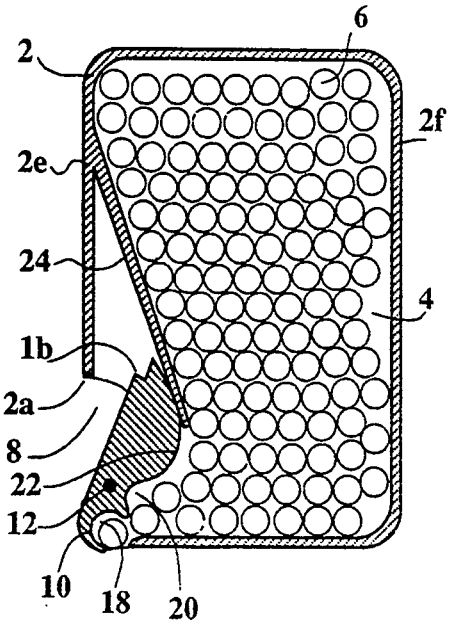
FIG. 4 is a sectional view along line IV—IV of FIG. 1 showing the internal structure of the dispenser, with the dispensing member in its closed position.

The portions of the housing side walls 2*c*, 2*d* adjacent the dispensing opening 8 in the end wall 2*e* occupied by the dispensing member 10 are recessed, as shown at 14 in FIGS. 2 and 3, to facilitate manually pivotting the dispensing member to its open position. The upper end of the dispensing member is formed with a notch 16 engageable with the end 2*g* of housing 2 bordering the opening 8, when the dispensing member is in its closed position.

The inner face of end 10*b* of the dispensing member 10 is formed with a semi-circular dispensing recess 18 dimensioned to receive a single table 6 and to dispense that tablet through opening 8 when the dispensing member 10 is pivotted to its open position, as illustrated in FIG. 3. A second recess 20 is formed on the inner face of dispensing member 10 adjacent to recess 18 for accommodating a second tablet 6, and for thereby preventing damage to the second tablet when the dispensing member is pivotted to its open position to dispense the tablet within recess 13.

The inner face of end 10*a* of the dispensing member 10 is formed with a convexly-curved surface 22. This surface is engaged by a leaf spring 24 integrally formed with the housing 2 for urging the dispensing member to its closed position as illustrated in FIG. 2.

The dispenser housing 2 may be made of any suitable plastic material. Preferably, the housing is transparent at the location of the dispensing opening 8 to permit viewing the dispensing of the tablets therefrom. The dispensing member 10 may be opaque or transparent. Similarly, the remainder of housing 2 may be opaque or transparent.

The illustrated dispenser is for one-time use. That is, when originally manufactured it is filled with a supply of the tablets 6 (e.g., artificial sweetener tablets), and the compartment 4 is then sealed closed. It will be appreciated, however, that the dispenser could be produced for multiple-time use wherein compartment 4 could be refilled with tablets 6, e.g., by providing a refilling opening in the housing, or by making the housing of two separable half-sections to permit refilling the compartment.

Figure 5:
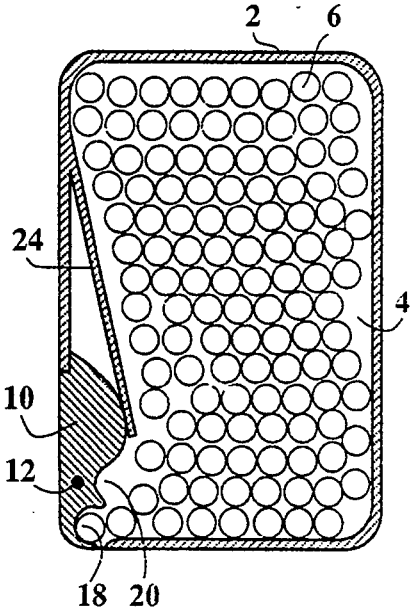
FIG. 5 is a view similar to that of FIG. 4 but showing the dispensing member in its open position.

The manner of using the tablet dispenser illustrated in FIGS. 1–5 will be apparent from the above description. Thus, leaf spring 24 normally urges dispensing member 10 to its closed position. When a tablet is to be dispensed, the user presses against the outer face of end 10*a* of the dispensing member 10 inwardly towards end wall 2*f*, to pivot that end of the member inwardly above its pivot pin 12, against the force of spring 24. This pivots outwardly from end wall 2*e* the opposite end 10*b* of the dispensing member formed with the dispensing recess 18, to thereby dispense the tablet 6 received within that recess. As soon as the dispensing member is released, leaf spring 24 pivots the member back to its closed position (FIGS. 3 and 5). If another tablet is to be dispensed, the dispensing member is again pressed inwardly to dispense a second tablet received within its dispensing recess 13. In this manner, as many tablets as desired may be individually dispensed.

By making the housing 2 transparent at the dispensing opening 8, the user can easily see each tablet as it is dispensed. This encourages the user to dispense the tablets directly into the coffee, tea, or other liquid to receive the tablets, rather than to dispense each tablet onto the user's palm and then to drop it into the liquid, as in the more conventional, but less hygienic, practice followed today.

Figure 6:
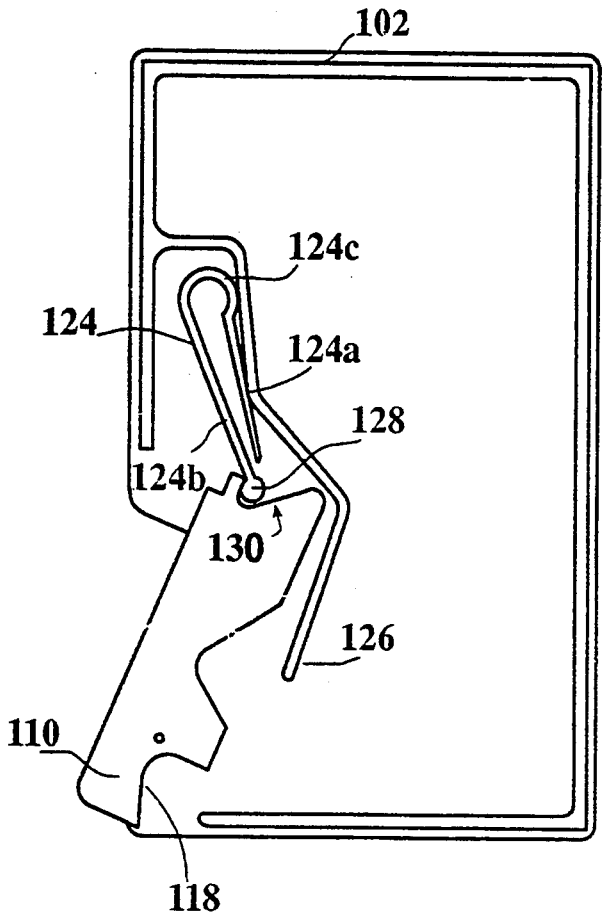
FIG. 6 is a side elevational view of another form of dispenser constructed in accordance with the present invention but having one-half of the housing removed to show internal structure.

The tablet dispenser illustrated in FIG. 6 is of similar construction as described above with respect to FIGS. 1–5, including a housing 102 and a pivotally mounted dispensing member 110 of generally the same construction as housing 2 and member 10, respectively, in FIGS. 1–5. The dispenser illustrated in FIG. 6, however, includes a separate spring member 124 having a first leg 124*a* bearing against a fixed element 126 of the housing 102, and a second leg 124*b* bearing against the pivotal dispensing member 110, the two legs being joined by an elastic U-bend 125*c*.

Leg 124*b* terminates in a rounded tip 128 received within a rounded recess 130 formed in the pivotal dispensing member 110. Element 126 is fixed to the inner face of housing 102 and substantially shields the pivotal dispensing member 110, except the lower end thereof formed with the dispensing recess 118, from the tablets within the housing.

In all other respects the tablet dispenser illustrated in FIG. 6 is constructed, and is used, in the same manner as described above with respect to FIGS. 1–5.

While the invention has been described with respect to two preferred embodiments, it will be appreciated that many other variations, modifications and other applications of the invention may be made.

What is claimed is:

1. A tablet dispenser, comprising:

a housing formed with a compartment for receiving a plurality of tablets to be dispensed, and with a dispensing opening for dispensing tablets from said compartment;

said housing including a top wall, a bottom wall, first and second opposed side walls, and first and second opposed narrow end walls, said dispensing opening being formed in said first end wall adjacent said bottom wall;

said compartment being of a length and width to receive a plurality of tablets, but of a thickness, defined by said first and second narrow end walls, only slightly greater than the thickness of one of the tablets such that the tablets received therein form a single layer;

and a dispensing member mounted between said side walls adjacent said dispensing opening in said first end wall and manually movable either to a closed position closing said dispensing opening, or to an open position to dispense a tablet from said compartment through said dispensing opening;

said dispensing member being pivotally mounted at a pivot point intermediate a first end thereof facing the top wall and a second end thereof facing the bottom wall;

said second end of the dispensing member being formed on an inner surface thereof with a recess for receiving a single tablet, such that manually pressing said first end of the dispensing member inwardly towards said second end wall, while in its closed position, pivots said second end of the dispensing member outwardly from said first end wall to said open position to dispense the single tablet received in said recess in said second end through said dispensing opening.

2. The dispenser according to claim 1, further including a spring normally urging said dispensing member to its closed position but permitting the dispensing member to be manually moved to its open position to dispense a tablet from said compartment through said dispensing opening.

3. The dispenser according to claim 2, wherein said spring is a leaf spring integrally formed with said housing walls.

4. The dispenser according to claim 2, wherein said first end of the dispensing member is formed on an inner face thereof with a curved surface engageable with said leaf spring.

5. The dispenser according to claim 1, wherein said spring is a separate spring member having first and second legs joined by a U-bend, said first leg bearing against a fixed element of the housing, said second leg bearing against said pivotal dispensing member.

6. The dispenser according to claim 5, wherein said second leg terminates in a rounded tip received within a rounded recess formed in said pivotal dispensing member.

7. The dispenser according to claim 5, wherein said fixed element of the housing is fixed to the inner face of the housing and substantially shields the dispensing member, except the end thereof formed with said dispensing recess, from the tablets within the housing.

8. The dispenser according to claim 1, wherein the portions of the side walls adjacent to and on opposite sides of the dispensing opening in said first end wall are recessed to facilitate manually pivotting the dispensing member to is open position.

9. The dispenser according to claim 1, wherein said dispensing member is formed on its inner surface with a second recess adjacent said first recess for accommodating a second tablet and for thereby preventing damage to the second tablet when the dispensing member is pivotted to its open position to dispense the tablet within said first recess.

10. The dispenser according to claim 1, wherein said housing is of the general shape and dimensions of a credit card, and is of a length of 75–100 mm, a width of 45–65 mm, and a thickness of 3–10 mm.

11. The dispenser according to claim 1, wherein said housing is transparent at the location of said dispensing opening to permit viewing the dispensing of tablets therefrom.

12. The dispenser according to claim 11, wherein the remainder of said housing is opaque.

* * * * *